US005641024A

United States Patent [19]

Lopez Alvarez

[11] Patent Number: 5,641,024

[45] Date of Patent: Jun. 24, 1997

[54] BUSH FIRE FIGHTING MACHINE

[76] Inventor: Argimiro Lopez Alvarez, Av. De Galicia No. 84, 33212 Gijon (Asturias), Spain

[21] Appl. No.: 414,283

[22] Filed: Mar. 31, 1995

[51] Int. Cl.[6] ..... A62C 3/02

[52] U.S. Cl. ..... 169/52; 169/24; 169/54; 169/48; 169/91; 47/1.44

[58] Field of Search ..... 169/24, 46, 54, 169/48, 91, 52; 47/1.44

[56] References Cited

U.S. PATENT DOCUMENTS

| | | | |
|---|---|---|---|
| 1,799,035 | 3/1931 | Benien et al. | 47/1.44 |
| 1,940,170 | 12/1933 | Howery et al. | 47/1.44 |
| 2,576,930 | 12/1951 | Everts | 169/46 |
| 2,709,998 | 6/1955 | Broad . | |
| 3,164,927 | 1/1965 | Holloway | 47/1.44 |
| 3,785,439 | 1/1974 | Britt | 169/24 |
| 3,805,766 | 4/1974 | Hammon | 47/1.44 |
| 4,875,526 | 10/1989 | Latino et al. | 169/24 |

FOREIGN PATENT DOCUMENTS

| | | | |
|---|---|---|---|
| 42750 | 11/1973 | Australia | 169/54 |
| 2652268 | 3/1991 | France . | |

OTHER PUBLICATIONS

"Machine Lessens Dangers of Prairie Fires," Popular Mechanics, p. 914 Jun. 1915.

*Primary Examiner*—Gary C. Hoge
*Attorney, Agent, or Firm*—Rodman & Rodman

[57] ABSTRACT

The machine constitutes a tracked type vehicle (1) able to adapt itself to the various terrain irregularities. It includes nozzles to project pressurized air (11) fed by compressors (8) placed upon the general machine chassis, including furthermore fire producing gas projection nozzles (12) that produce fire as the machine advances, so that said nozzles (11) and (12) direct air and fire in the desired direction in order to create a fire lane. The machine incorporates the means necessary to hook a trailer (19) carrying water tanks (21), fire extinguishing fluid tanks (22) and mixing tanks (23) to enable the projection of said components in case of emergency. Said machine is particularly designed to burn off land strips close and parallel to a fire front, so as to prevent it from spreading.

5 Claims, 3 Drawing Sheets

FIG. 3
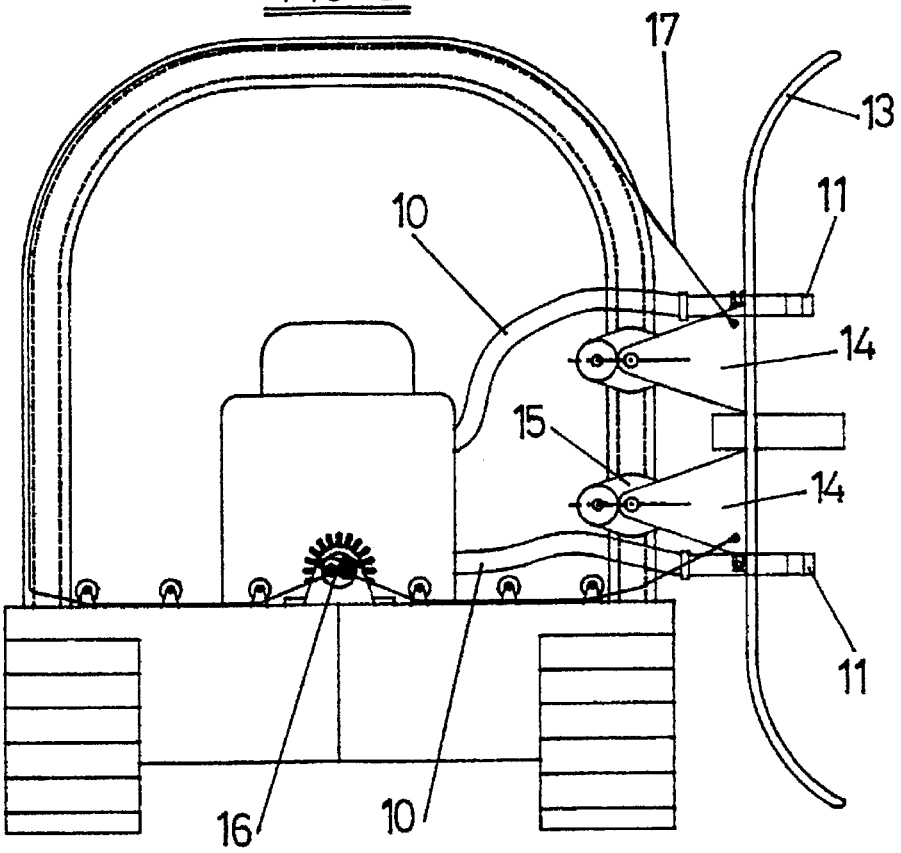
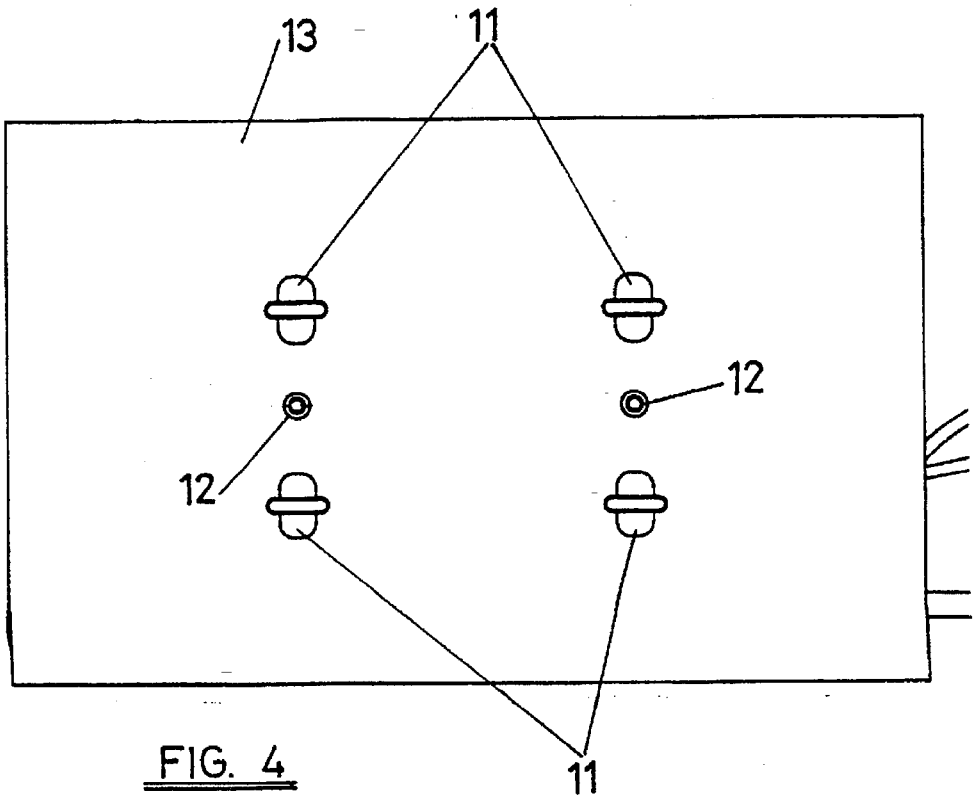
FIG. 4

BUSH FIRE FIGHTING MACHINE

DESCRIPTION

Object of the Invention

The invention refers to a bush fire-fighting machine, and more specifically to a machine to be used to create fire lanes to allow preventing a bush fire from expanding, by cutting it off at its advancing front. The machine is made up of a tracked type vehicle fitted with driving means as well as air and fire projectors, capable of towing a trailer carrying water, fire-extinguishing fluid and a mixture of both.

BACKGROUND OF THE INVENTION

Whenever fires break out in bush land and similar areas, the best way to fight them is through the projection of water and/or foam using a number of different means such as hydroplanes, hoses connected to fire trucks, etc. There are also machines able to get very close to the fire and fitted with tanks and hoses that may be used to project water toward the fire.

Generally, whenever the fire may not be cut off immediately, either because it has started in areas where it can propagate quickly or because it takes up a wide front, classic "fire lanes" are commonly used, which are effected or are tried to be effected at areas distant from and parallel to the propagation front, so that the fire is stopped when it reaches this fire lane and no other areas are then affected by the fire.

The fire lane is made using machines that pull trees off, upturn the ground, etc.

Now, there is no doubt that the strip making up a fire lane effected as previously described very often is not efficient, due to the fact that debris from trees, branches and other combustible products that come alight when the fire gets close are left behind, and the fire lane then does not stop the progress of the fire.

DESCRIPTION OF THE INVENTION

The machine hereby described has been designed precisely to create a fire lane and thus fight fire propagation, all of this based on simple and efficient means.

More specifically, the machine is made up from what may be considered to be a conventional tracked type back-up vehicle, incorporating on its chassis several broadside bridges based on double "T" section beams running from one side to the other of the fore mentioned general structure of the machine, making up what has been said or have been called bridges, that are nothing more than internally and externally channeled metal beams on which run means or devices made up of bearings, and to which means is joined a plate that shall be placed sideways with respect to the general vehicle structure, protecting it. The plate is fitted with holes to allow the passage of air projecting nozzles and gas projecting nozzles that shall be set alight when it comes out of its corresponding nozzles, producing a fire that shall be projected towards the ground to produce the fire lane itself. The plate is constituted with a side protection device for the machine and the air nozzles are provided with a medium capable of supplying air with a strength greater than that of the natural fire propagation. These features achieve the purpose of providing a lane that shall catch fire and that logically, once the machine passes by, the fire will burn itself out given that the naturally prevalent wind shall be blowing in the opposite direction to that of the previously made fire lane. As previously mentioned, the side mounted plate constitutes a protection means to avoid the fire being produced or provoked by the machine affecting it.

The machine is nevertheless fitted with towing apparel to pull a trolley fitted with a tank of fire extinguishing fluid, another water tank and a third mixing tank so that, should the fire being set or produced by the machine extend beyond the screen formed by the side plate, said fire may then be put out using hoses connected to said tanks.

Because of the assembly of the plate, and using the bearings running on the profiled or channelled beams, this plate may be placed on any of the two sides, by way of simply sliding it across, or it may also be placed so that it faces the upper side if it is being transported or taken from one side of the machine to the opposite one, so that it may be used at any time to make or create a fire lane in any direction, so that depending on the wind direction the plate may be located on one side or the other to protect the machine as previously described.

DESCRIPTION OF THE DRAWINGS

In order to complement the description being made and with the purpose of aiding towards a better comprehension of the characteristics of the invention, this patent specification is accompanied by a set of drawings forming part thereof and on which, with an exclusively illustrative and not limitative character, the following has been represented:

FIG. 3. Shows an end view of the machine shown in the previous figures.

FIG. 4. Finally shows a side elevation view of the protector plate assembled upon the U section beams forming part of the general structure of the machine object of the invention.

PREFERRED EXECUTION OF THE INVENTION

Figure 1:
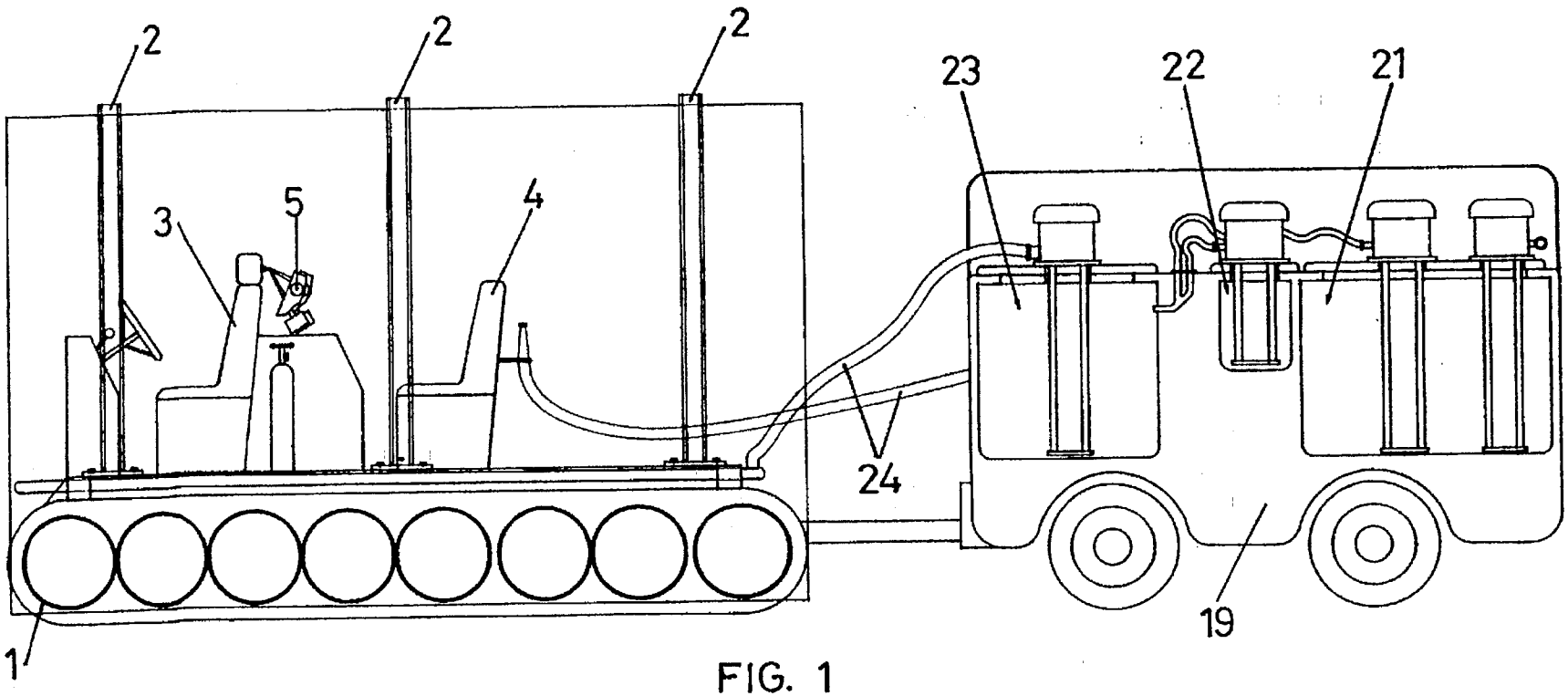
FIG. 1. Shows a side elevation view of the fire-fighting machine object of this invention, with the trailer hooked to it, further showing the side protection plate placed on the background side.

As may be observed in the fore mentioned figures, the machine object of the invention constitutes what may be considered to be a tracked type back-up vehicle, generally referenced by the number (1), on which chassis have been fitted a number of beams (2), which are made of metal and internally and externally channelled with double "T" configuration, forming broadside bridges which function shall be later revealed. The chassis of the vehicle incorporates seats (3) for its driver and (4) for his companion, with smoke masks (5) and other fire protection elements and devices, including also a gas bottle (7) and a couple of air compressors (8).

Out of the gas bottle (7) come out two gas conduction (9) hoses, whereas out of the compressors (8) come out respective conduits (10) that end in aim-capable nozzles (11), whereas the gas conduits (9) end in long and rigid nozzles.

The machine is complemented by a protection plate (13) made of metal and adopting a profile as shown in FIG. 3, being rectangular in shape and further being joined to devices (14) fitted with bearings (15) that are guided and slide upon the double "T" beams (2), so that said plate may then be placed on either of the two sides of the machine or facing upwards, given that the bearings (15) slide freely along the bridges formed by the beams (2), all of this with the purpose of protecting one or the other side, depending on the side on which said fire lane is going to be effected using the machine.

The transversal travel of the plate (13) shall be effected using a motor (16) fitted with two shafts, which motor (16) shall pull a cable (17) joined at its ends to two different points on the plate (13), specifically to its fixing devices (14), with the particularity that the fore mentioned cable (17) shall travel along the external channel of the corresponding beam (2).

All the components of the machine shall be supplied using a diesel electric power generator (18) mounted upon its own general frame. The aim-capable nozzles (11) shall be set so that they poke through the holes made to that effect in the plate itself (13), whereas the nozzles (12) do also poke through holes made in the plate, having represented the distribution of the nozzles (11) and (12) upon the plate, as may be observed in FIG. 4.

Figure 2:
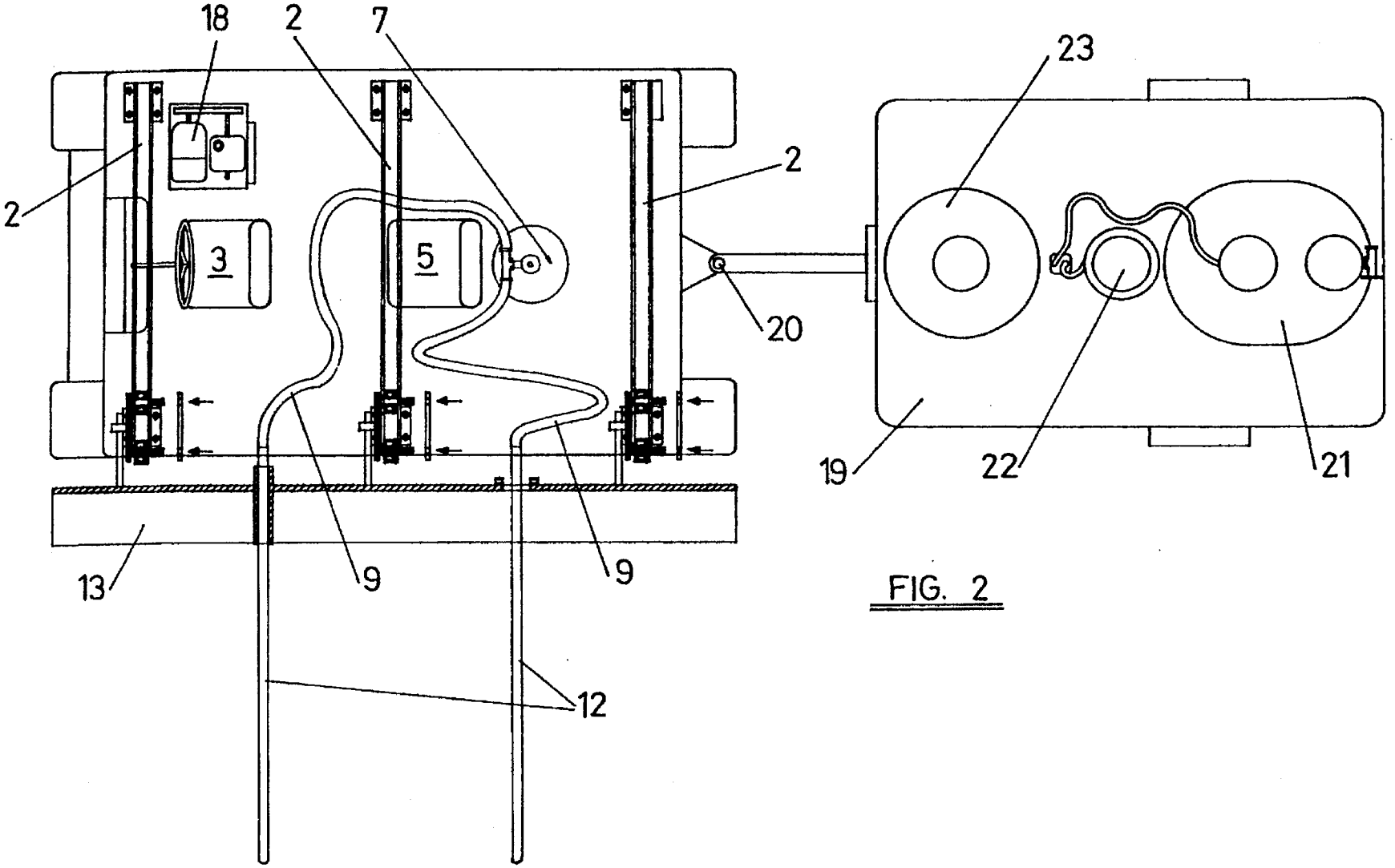
FIG. 2. Shows a plan view of the machine shown in the previous figure.

The machine is furthermore complemented with a trailor (19) fitted with hooking means (20) to couple it to the machine itself as shown in FIG. 2, the trailer (19) also includes a water tank (21), a fire extinguishing fluid tank (22) and a tank (23) for mixing the fore mentioned components, complementing said trailer (19) by a series of hoses and pipes (24) that distribute the mixture or the water out of both sides of the machine.

In accordance with the structure mentioned and shown in the figures, whenever a fire lane is to be made using the machine of reference, it shall then be arranged so that it runs perpendicularly to the wind direction at that time, that is to say, it shall be placed perpendicularly to the advance of the fire to be cut off and the protection plate (13) shall be placed upon the respective side of the machine, proceeding then to project gas out of the gas bottle (7) upon the nozzles (12), lighting said gas and producing fire against the ground at a distance of approximately 2 meters from the machine. Furthermore, the nozzles (11) shall project air coming out of the compressors (8), which air projection shall logically be in the direction opposite that of the naturally blowing wind, being further able to aim said air in any direction by way of the aim-capable nozzles (11).

Machine operation is therefore as follows: placing the machine at an optimum distance from the front of the fire, an air current greater than that blowing against it shall then be created, which air current shall logically be produced by the nozzles (11), as previously mentioned. The burners are then set alight, that is to say, gas is projected out and set alight through the nozzles (12), so that machine will then create a fire strip as it advances, which fire strip will then burn itself out as the machine passes due to the wind blowing in the opposite direction, this strip preventing the advance of the fire whenever the fire front reaches the fore mentioned strip.

As previously mentioned, should the fire extend itself inside the metal protection plate (13), then the trailer (19) hoses (24) would be used to project water and foam to put out said unwanted fire.

It is not considered necessary to extend this description any further to enable any expert in the subject matter to understand the invention and the benefits derived therefrom.

The materials used, shape, size and arrangement of the elements may be varied whenever said variations do not alter the essential features of the invention.

The terms in which this specification has been written must always be interpreted in a wide and not limitative sense.

I claim:

1. A bush fire-fighting machine for burning off a strip of terrain parallel to the front of an advancing bush fire comprising, a traction vehicle having a chassis with an upper platform having a front end, a rear end and opposite sides between the front and rear ends, a plurality of beams with a double "T" cross-section that defines a bearing guide, each said beam being mounted on the upper platform in the form of an inverted "U" that forms a bridge-like span that extends from one opposite side of the upper platform to the other opposite side of the upper platform, a protector plate movably supported on said beams, said protector plate being connected to bearings slidably mounted in the bearing guide of said beams to permit movement of said protector plate from one of the opposite sides of the upper platform to the other opposite side of the upper platform or to an upper position spaced above the upper platform, a cable joined at two points to said protector plate, a motor connected to said cable to move said cable and said protector plate from one of said opposite sides of said upper platform to the other of said opposite sides of said upper platform, said protector plate being fitted with openings for nozzles to project air and fire-producing gas.

2. The bush fire-fighting machine as claimed in claim 1, including an air compressor and a gas container provided on said upper platform, and wherein a plurality of air projection nozzles extend through a first predetermined number of openings in said protector plate and a plurality of gas projection nozzles extend through a second predetermined number of openings in said protector plate, a corresponding first plurality of air hoses connecting said air compressor to said air projection nozzles and a corresponding second plurality of gas hoses connecting said second predetermined number of gas projection nozzles to said gas container.

3. The bush fire-fighting machine as claimed in claim 2, wherein said air projection nozzles and said gas projection nozzles are directionally adjustable to permit projection of at least one stream of air and at least one stream of gas in any selected direction.

4. The bush fire-fighting machine as claimed in claim 1, including at least one operator position provided on said upper platform to accommodate an operator of the bush fire-fighting machine, a protection device associated with each operator position for protection of any operator, and a diesel electric power generator for powering said motor and providing power to selected components of the bush fire-fighting machine.

5. The bush fire-fighting machine as claimed in claim 1, further including a trailer joined to said traction vehicle, said trailer including a water tank, a fire extinguishing fluid tank and a mixing tank, each of said tanks being provided with hoses and pipes for conveying contents of the water tank and the fire extinguishing tank into the mixing tank and for conveying the contents of any of said tanks directly outward of said tanks for separate dispensation of the contents of each of said tanks from at least one of the opposite sides of said upper platform.

* * * * *